US007609009B2

(12) United States Patent
Tanaka et al.

(10) Patent No.: US 7,609,009 B2
(45) Date of Patent: Oct. 27, 2009

(54) LINEAR ION ACCELERATOR

(75) Inventors: Hirofumi Tanaka, Tokyo (JP); Kazuo Yamamoto, Tokyo (JP); Hisashi Harada, Tokyo (JP); Hiromitsu Inoue, Tokyo (JP); Takahisa Nagayama, Tokyo (JP); Nobuyuki Zumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 109 days.

(21) Appl. No.: 11/967,612

(22) Filed: Dec. 31, 2007

(65) Prior Publication Data

US 2008/0164421 A1 Jul. 10, 2008

(30) Foreign Application Priority Data

Jan. 10, 2007 (JP) ..... 2007-002186

(51) Int. Cl.
*H05H 9/00* (2006.01)
*H01J 27/00* (2006.01)

(52) U.S. Cl. ..... 315/505; 315/506; 315/507; 315/5.39; 315/5.41; 315/5.42; 250/396 R

(58) Field of Classification Search ..... 315/505, 315/506, 507, 5.39, 5.41, 5.42; 250/396 R
See application file for complete search history.

(56) References Cited

U.S. PATENT DOCUMENTS 6,777,893 B1 * 8/2004 Swenson ..... 315/505
6,888,326 B2 * 5/2005 Amaldi et al. ..... 315/505
7,098,615 B2 * 8/2006 Swenson et al. ..... 315/505

OTHER PUBLICATIONS

Y. Iwata, et al., "Alternating-Phase-Focused Linac for an Injector of Medical Synchrotrons", Proceedings of EPAC, Lucerne, Switzerland, 2004, pp. 2631-2633.

* cited by examiner

*Primary Examiner*—Nikita Wells
(74) *Attorney, Agent, or Firm*—Oblon, Spivak, McClelland, Maier & Neustadt, L.L.P.

(57) ABSTRACT

The electrode lengths of a plurality of electrodes linearly arranged in an acceleration cavity are proportional to the velocity of a traveling ion beam. Further, the electrode length is so designated that, in each half of a predetermined cycle in the ion beam direction of travel, the absolute value of a difference, relative to a length that is proportional to the beam traveling velocity is equal to or greater than a value corresponding to the phase width of the traveling ion beam, is provided for electrodes that do not exceed three units and that are fewer than electrodes allotted to half the predetermined cycle.

4 Claims, 6 Drawing Sheets

FIG. 6

| CATEGORY | | PRESENT EMBODIMENT | CONVENTIONAL ART |
|---|---|---|---|
| COMPACTNESS | TOTAL LENGTH (m) | 2.1 | 3.0 |
| COST | | LOW | HIGH |
| CONSUMED POWER (kW) | | 150kW | 230kW |
| BEAM PERFORMANCE | TRANSMISSION EFFICIENCY | 90% | 20% |
| | ACCELERATION CURRENT | 20mA | 2mA |

LINEAR ION ACCELERATOR

BACKGROUND OF THE INVENTION

1. Field of the Invention

The present invention relates to an APF (Alternating-Phase-Focused) linear ion accelerator that accelerates an ion beam, such as a carbon beam or a proton beam, to obtain the ion beam of high energy.

2. Description of the Background Art

An APF linear ion accelerator includes an acceleration cavity in which a plurality of cylindrical electrodes called drift tubes (hereinafter referred to simply as drift tubes) are arranged along the linear path of an ion beam that is injected into the acceleration cavity, so that the lengths of the drift tubes are changed sinusoidally, in consonance with a predetermined cycle, in the direction in which the ion beam passes. This change in tube lengths is hereinafter called an oscillation having a predetermined cycle. Furthermore, gaps are formed between the drift tubes, while a radio frequency acceleration electric field is applied to the individual gaps. Thereafter, when an ion beam passes across one of the gaps (hereinafter referred to as acceleration gaps), the ion beam is accelerated by the radio frequency acceleration electric field applied to the gap, and simultaneously, a focusing force is applied to the ion beam in the transverse direction (which is perpendicular to the direction of travel of the beam, which is termed the vertical direction). When an ion beam has been accelerated and has attained a predetermined extraction energy by passing across a predetermined number of acceleration gaps, the ion beam is extracted from the linear ion accelerator as an extraction beam (Non-patent Document 1) Y. Iwata, et.al., "Alternating-Phase-Focused Linac for an Injector for Medical Synchrotron," Proceedings of EPAC 2004, Lucerne, Switzerland, p2631.

SUMMARY OF THE INVENTION

For the transporting of an ion beam through a linear ion accelerator, it is necessary to focus the ion beam both in a beam direction of travel and in a direction perpendicular to the direction of travel. To enable such focusing, an APF linear ion accelerator applies a radio frequency acceleration electric field to the acceleration gaps. Generally, when the focus of an ion beam is in the direction of travel, it diverges in the perpendicular direction, while on the other hand, when an ion beam has diverged from the beam direction of travel, it is focused in the perpendicular direction. The focusing or the divergence of the beam is determined by the acceleration phase of the radio frequency electric field. Thus, assuming that the radio frequency electric field is $E=E0\cdot\cos(\phi 0)$, when $\phi 0$ is positive, the ion beam diverges in the beam direction of travel and is focused in the perpendicular direction, and when $\phi 0$ is negative, the ion beam is focused in the beam direction of travel and diverges in the perpendicular direction. Therefore, during a period beginning with the injection of the ion beam into the APF linear ion accelerator and continuing until the ion beam is extracted therefrom, the acceleration phase $\phi 0$ provided for each predetermined interval must be shifted between positive and negative in order to focus the ion beam in the vertical direction or in the transverse direction. Since the focusing force generated by the radio frequency electromagnetic field is generally lower than the focusing force generated by an electromagnet, and since the beam focusing force F can be approximately represented as $F=F0\cdot\sin(\phi 0)$, conventionally, it is necessary for the APF linear ion accelerator to change the acceleration phase $\phi 0$ up to positive or to negative of about $\pm\pi/2$, in order to increase the beam focusing force (non-patent document 1). It should be noted that by absolutely changing the acceleration phase either to positive or to negative, i.e., greatly increasing the oscillation in the acceleration phase, this corresponds to an increase or, conversely, a reduction in the length of a drift tube (hereinafter referred to as the electrode length) relative to a predetermined value. A predetermined value for the electrode length is designated so that a specific acceleration phase appears for each acceleration gap, and so determined that it is proportional to the velocity of the ion beam as it travels through the pertinent drift tube.

As a linear ion accelerator for practical use, one providing a reduction in the entire accelerator length is preferred, while taking into account design and manufacturing costs, and a high current acceleration is also preferred to provide an increase in the beam intensity when an ion beam is employed at the rear stage. However, in this instance, for an APF linear ion accelerator, there exist the following problems, which also include an accelerator length reduction and a high current acceleration and, especially, when the object is the acceleration of proton, the availability of an accelerator acceptable for practical use, one of which has yet to be developed.

(1) Reduction in the Overall Length of an Accelerator

As described above, conventionally, the acceleration phase $\phi 0$ must be absolutely changed by about $\pm\pi/2$, and since the acceleration electric field E is determined as $E=E0\cdot\cos(\phi 0)$ the effective radio frequency acceleration electric field is reduced. Therefore, in order to accelerate an ion beam until it reaches a high energy, the number of acceleration gaps to which the acceleration electric field is to be applied must be increased. Accordingly, the number of drift tubes must be increased, and thus, the overall length of the APF linear ion accelerator is extended. Essentially, this constitutes a length reduction problem for which a solution is expeditiously required.

(2) High Current Acceleration

As ions are being accelerated by an accelerator, Coulomb repulsion among the ions occurs, and thus, a divergence force is exerted. This is called a space charge effect. Since a greater space charge effect is obtained when a mass of ions is lighter, the divergence force is especially increased when the mass is made up of proton.

As described above in (1), for a conventional APF linear ion accelerator, since the acceleration electric field for each acceleration gap can not be increased, an increase in the number of drift tubes, i.e., the number of acceleration gaps, is required in order to accelerate the ion beam until a predetermined high energy has been attained. As a result, the ion beam must be accelerated slowly using a long linear ion accelerator. Therefore, the affect produced by the space charge effect is increased, and the divergence of the ion beam becomes great during the acceleration period. Especially for proton, since the ratio of the mass to charges is small, the space charge effect is great, and the high current acceleration of a proton beam is difficult until a high energy has been reached.

Furthermore, as described above, conventionally, the acceleration phase $\phi 0$ must be greatly changed to about $\pm\pi/2$. The acceleration beam is accelerated by being expanded slightly in the direction the beam is traveling; however, when the acceleration phase of the acceleration beam is slightly changed, the radio frequency electric field differs greatly, and as a result, the beam focusing force differs greatly between that for ions located in the center of the acceleration beam and ions located at the edge. Therefore, divergence of the beam occurs at the edge and the beam moves out of the stable acceleration region or collides with a drift tube, so that only the ions near the center of the beam are stably accelerated and the transmission efficiency (the ratio of the extracted beam relative to the injected beam) is lowered. From this viewpoint, high current acceleration is also difficult.

When a focusing force greater than the above described divergence force can not be generated by a radio frequency electric field applied to the acceleration gap, such an apparatus can not be established as a linear ion accelerator. While taking these matters into account, APF linear ion accelerators using proton have been studied all over the world; however, an acceptable practical use accelerator has yet to be developed.

According to an aspect of the present invention, 1. An APF linear ion accelerator comprising: an accelerator cavity configured to accelerate a traveling ion beam by a radio frequency electric field; a radio frequency power supply device configured to generate the radio frequency electric field; a coaxial tube and a coupler configured to supply the radio frequency electric field generated by the radio frequency power supply device to the acceleration cavity; and a plurality of cylindrical electrodes having hollow central axial portions and linearly arranged in the acceleration cavity in the axial direction with intervening acceleration gaps to have predetermined intervals, wherein the radio frequency electric field supplied to the acceleration cavity via the coaxial tube and the coupler is applied to the acceleration gaps, which gradually accelerates the velocity of an ion beam that passes through the hollow central axial portions of the cylindrical electrodes, thereby extracting the ion beam injected at a predetermined injection energy until a predetermined extraction energy, wherein each of the cylindrical electrode has an electrode length in an arrangement direction of the cylindrical electrodes, the electrode length being a sum of a velocity dependent electrode length and an oscillation component, the velocity dependent electrode length designated in proportional to a traveling velocity in the cylindrical electrode determined as a velocity at which the ion beam is to pass through the cylindrical electrode, the oscillation component obtained by changing an electrode length to positive or to negative with respect to the velocity dependent electrode length pursuant to a predetermined cycle and depending on a position of the plurality of cylindrical electrodes, wherein the cylindrical electrodes in each half of the predetermined cycle include an electrode group containing at least one cylindrical electrode having an electrode length of which the absolute value of the oscillation component is larger than a phase length defined by a length in a direction of accelerating the ion beam which corresponds to half of a predesignated phase width in the direction of accelerating the ion beam, and wherein a number of cylindrical electrodes contained in the electrode group is smaller than a number of cylindrical electrodes allotted to each half of the predetermined cycle, and is equal to or greater than one and equal to or smaller than three.

Since this arrangement is employed for the APF linear ion accelerator of the aspect of the invention, the total length can be reduced, compared with a conventional APF linear ion accelerator, and an ion beam having a higher current can be accelerated until a high energy level is reached.

BRIEF DESCRIPTION OF THE DRAWINGS

FIG. 6 is a table showing a comparison of the functions of a conventional APF linear ion accelerator and an APF linear ion accelerator of the embodiment of invention.

Hereinafter, 1 represents an acceleration cavity; 2 represents a drift tube; 2*a* represents a first drift tube; 2*b* represents a last drift tube; 3 represents an acceleration gap; 4 represents a velocity dependent electrode length; 5 represents a radio frequency power supply device; 6 represents a coaxial tube; and 7 represents a coupler.

DESCRIPTION OF THE PREFERRED EMBODIMENTS

First Embodiment

Figure 1:
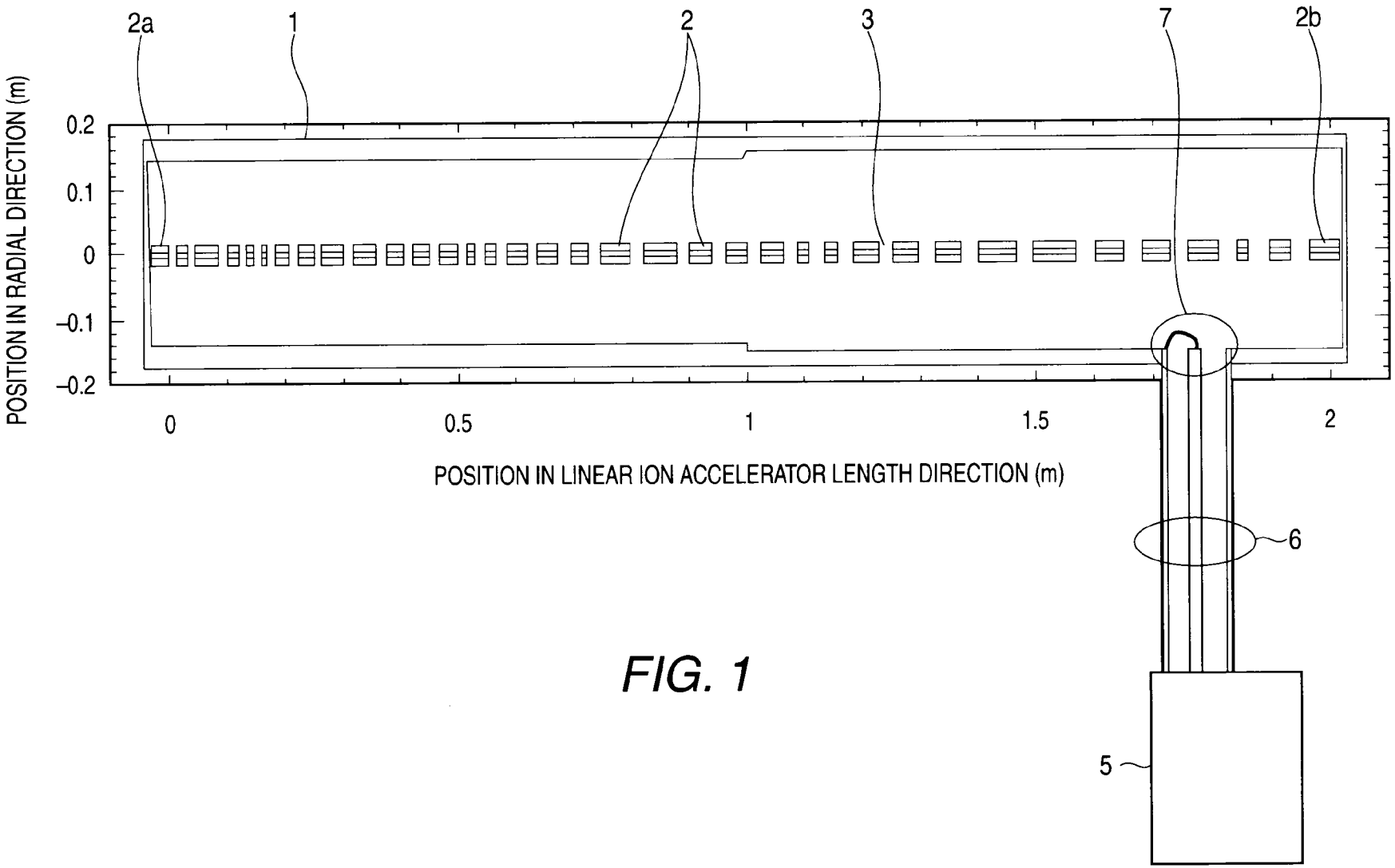
FIG. 1 is a cross sectional view of an APF linear ion accelerator according to a first embodiment of the present invention.

FIG. 1 is a cross sectional view of the concept of an APF linear ion accelerator according to a first embodiment of the present invention. In FIG. 1, the horizontal axial direction represents the direction of the length of the APF linear ion accelerator (or the central axial direction), the vertical axial direction represents a direction perpendicular to the central axial direction of the linear ion accelerator, and numerical values provided for the vertical axis and the horizontal axis are example values representing locations in the individual directions using the unit of the meter. An acceleration cavity 1 is used to confine a radio frequency electric field, and a plurality of cylindrical electrodes 2, called drift tubes, are arranged, in the manner as shown in FIG. 1, along the central axis of the acceleration cavity 1 (the horizontal axis that runs across 0 of the scale for the vertical axis in FIG. 1). The number of the cylindrical electrodes becomes sometimes from several to several hundreds in accordance with the acceleration condition. And 2*a* is a first drift tube 2*a* and 2*b* is a last drift tube 2*b*. Acceleration gaps 3 are defined as gaps formed between adjacent drift tubes 2. Although not shown in FIG. 1, generally the drift tubes 2 are secured in the acceleration cavity 1 by using rods called stems. Also, although again not shown in FIG. 1, metal plates called ridges may be mounted between the stems and the wall of the acceleration cavity 1.

The horizontal axial direction has as its origin the terminal location of the first drift tube 2*a*, i.e., the position at which the first acceleration gap begins, and the vertical axial direction has as its origin the location of the central axis of the acceleration cavity 1, for example, whereat the cross sectional shape of the acceleration cavity 1 in the vertical direction is a circle. A radio frequency power supply device 5 generates and supplies a radio frequency, and a coaxial tube 6 connects the radio frequency power supply device 5 to the acceleration cavity 1. A coupler 7 is provided by connecting the central conductor of the coaxial tube 6 to the external body of the cavity 1 at the location at which the coaxial tube 6 is connected to the cavity 1. Through the coupler 7, a radio frequency electric field is supplied by the radio frequency power supply device 5 to the acceleration cavity 1. Further, a radio frequency acceleration electric field is excited in the acceleration gaps 3.

Figure 2:
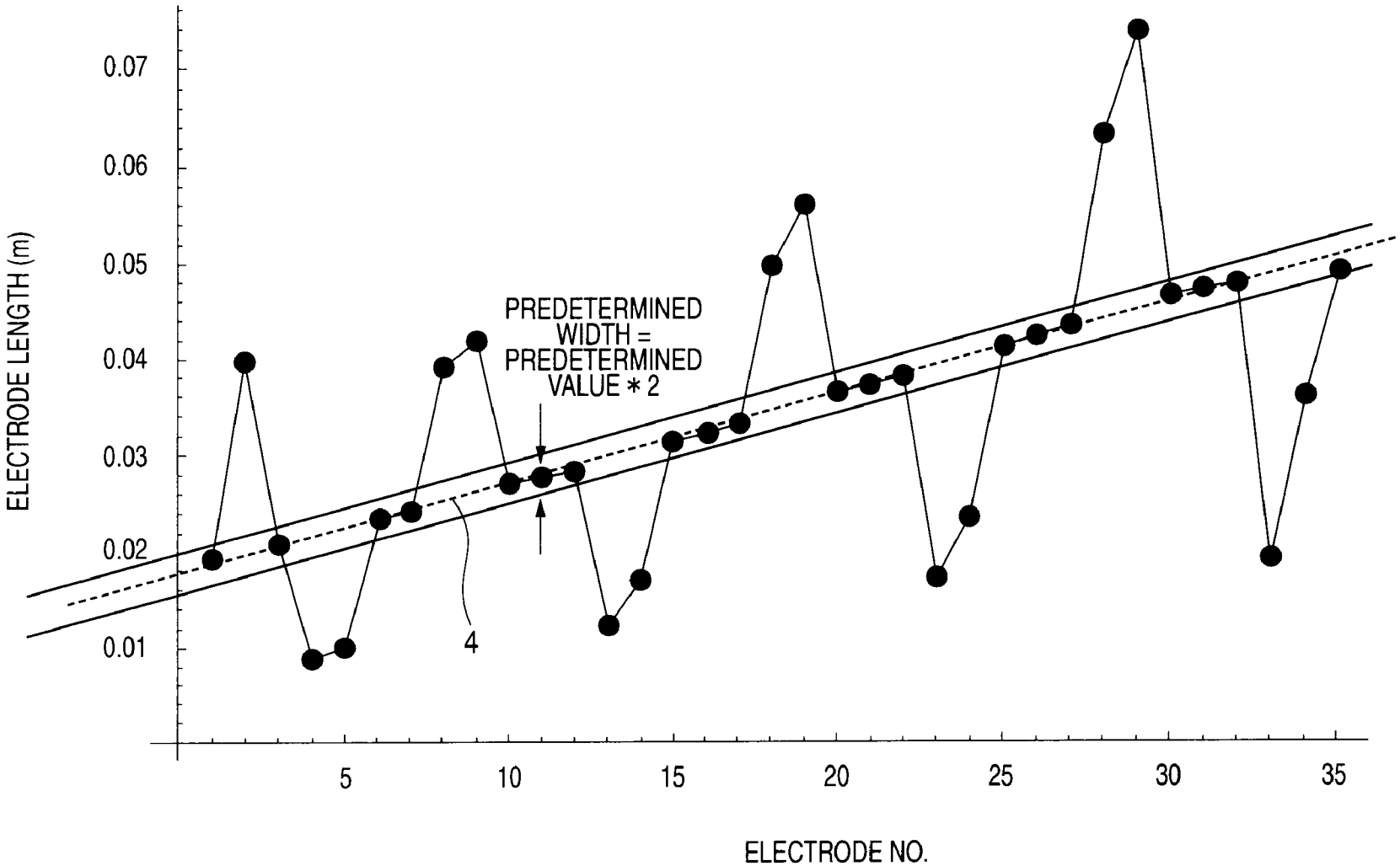
FIG. 2 is a graph showing the individual electrode lengths for a cylindrical electrode array of the APF linear ion accelerator of the first embodiment of the invention.

FIG. 2 is a graph showing the lengths of multiple drift tubes 2 arranged along the central axis of the acceleration cavity 1 according to the embodiment of invention. The horizontal axis in FIG. 2 represents identification numbers that are allocated to the individual drift tubes 2, and are called electrode numbers. These electrode numbers are sequential numbers: electrode number "1" is allocated to the next drift tube 2 in line to receive an ion beam injected into the first drift tube 2*a* (2*a* in FIG. 1); and while referring to FIG. 2, electrode number "35" is allocated to the last drift tube 2*b* (2*b* in FIG. 1) (thus, the total number of drift tubes is 36). The vertical axis represents the length of each drift tube 2 (hereinafter referred to as an electrode length), and a black circle is used in FIG. 2 to designate an electrode length corresponding to an electrode number.

An explanation will now be given for the acceleration of an ion beam in the APF linear ion accelerator having the above arrangement. An ion beam moves from the left to the right in FIG. 1 through the vicinity of the origin of the vertical axis, i.e., moves through the drift tubes 2 arranged along the central axis of the acceleration cavity 1 and across the individual acceleration gaps 3. And as the ion beam passes across each acceleration gap 3, at a predetermined timing (phase), it is accelerated by a radio frequency acceleration electric field applied in the pertinent acceleration gap 3.

According to the APF linear ion accelerator of this embodiment of, not only an acceleration electric field in the vertical direction, i.e., not only an acceleration electric field in the beam direction of travel, but also an acceleration electric field in the transverse direction, perpendicular to the vertical, is applied at the acceleration gaps 3 in order to focus the ion beam or cause it to diverge. Therefore, because of these electric fields, not only does a focusing force in the vertical direction act on the ion beam but also one in the transverse direction.

The setup of the electrode lengths for the drift tubes 2 will now be described based on FIG. 2. The characteristics of the electrode lengths shown in FIG. 2 are as follows.

(i) As a basis, each drift tube has an electrode length that depends on the velocity of the ions that travel along the electrode.

Since the velocity of an ion beam is increased by ion acceleration, it is necessary to increase a so-called cell length, which is the sum of an acceleration gap and an electrode length, in consonance with the acceleration of ions, so that the acceleration phase condition at the position of the acceleration gap is matched. That is, assume that within a certain period, extending from the time an ion beam passes across a specific acceleration gap 3 until the time it passes across the next acceleration gap 3, the phase of a radio frequency electric field is changed to a specific phase, such as $2\pi$ ($2\pi$ mode) or $\pi$ ($\pi$ mode). A length equivalent to this period is defined as a cell length. Therefore, the cell length is proportional to the current velocity of the ions. Generally, as well as the cell length, the acceleration gap length is increased so proportional to the velocity of the ions in order to provide improved acceleration efficiency.

Since the electrode length of a drift tube 2 is obtained by subtracting the acceleration gap length, which is designated as being proportional to the ion velocity, from the cell length, which is also designated as being proportional to the ion velocity, the electrode length is proportional to the ion velocity. When the relationship of the electrode number and the electrode length is as shown in FIG. 2, using the graph, it is represented by a linear line. In FIG. 2, this line is depicted by a broken line 4. The actual electrode length has cyclically recessed and raised portions relative to the linear line 4, as shown in FIG. 2. An electrode length indicated by the linear line 4 is hereinafter referred to as a velocity dependent electrode length.

The basic electrode structure of a general linear ion accelerator, including the APF type, has been described. The linear line indicating the velocity dependent electrode length 4 actually has a predetermined width along the vertical axis. Ions to be accelerated move as a group having a width corresponding to an acceleration phase of about ±15 degrees in the direction of travel. Therefore, the velocity dependent electrode length 4 has a width equivalent to the length consonant with the acceleration phase. For example, in FIG. 2, the cell length in the vicinity of the injection portion is 3 cm, and when the $\pi$ mode acceleration is employed as an example, the velocity dependent electrode length 4 has a width of 3 cm×(±15 degrees/180 degrees)=±0.25 cm. For the sake of convenience in the following explanation, the velocity dependent electrode length 4 is regarded as not having a width, and in addition, a value corresponding to ½ the predetermined width described above is defined as a phase length that is to be added to, or subtracted from, the velocity dependent electrode length 4.

(ii) The electrode length is a length obtained through positively or negatively oscillating depending on an electrode number in a predetermined cycle, with respect to the velocity dependent electrode length 4 as a reference.

This has already been described. The acceleration cavity is formed by employing drift tubes having an electrode length obtained due to the occurrence of the oscillation having a predetermined cycle, while the extant state is a synchronous condition represented by employing the velocity dependent electrode length 4. While an ion beam is passing through the acceleration cavity, a specific ion beam focusing forces or divergent forces can be obtained. It should be noted that the idea expressed in (ii), as well as in (i), is the conventional view for the basic electrode arrangement of an APF linear ion accelerator. Therefore, no further explanation for this will be given.

(iii) Of the electrodes allotted to half a oscillation cycle, which is equivalent to the electrode length, the number of electrodes that satisfy a predetermined condition is smaller than the number of electrodes allotted to half the cycle, and is one or greater and three or smaller. In other words, in this cycle, the number of electrodes for which the electrode length is increased, or reduced, compared to the velocity dependent electrode length 4, by a value equivalent to a phase length that has been previously defined or greater, is less than the number of electrodes allotted to half the predetermined cycle, and is three or smaller. (The electrodes for which the electrode length is increased or reduced are called increased electrode groups and reduced electrode groups).

For example, while referring to FIG. 2, sequentially, every ½ cycle from the ion beam injection end, for the initial groups, the increased electrode group includes one electrode and the reduced electrode group includes two electrodes; for the next groups, the increased electrode group includes two electrodes and the reduced electrode group includes two electrodes; for the following groups, the increased electrode group includes two electrodes and the reduced electrode group includes two electrodes; and for the last groups, the increased electrode group includes two electrodes and the reduced electrode group includes two electrodes. It is obvious that the electrode count of each electrode group is smaller than the number of electrodes included in half a cycle because there are electrodes allotted to a predetermined width shown in FIG. 2.

Figure 3:
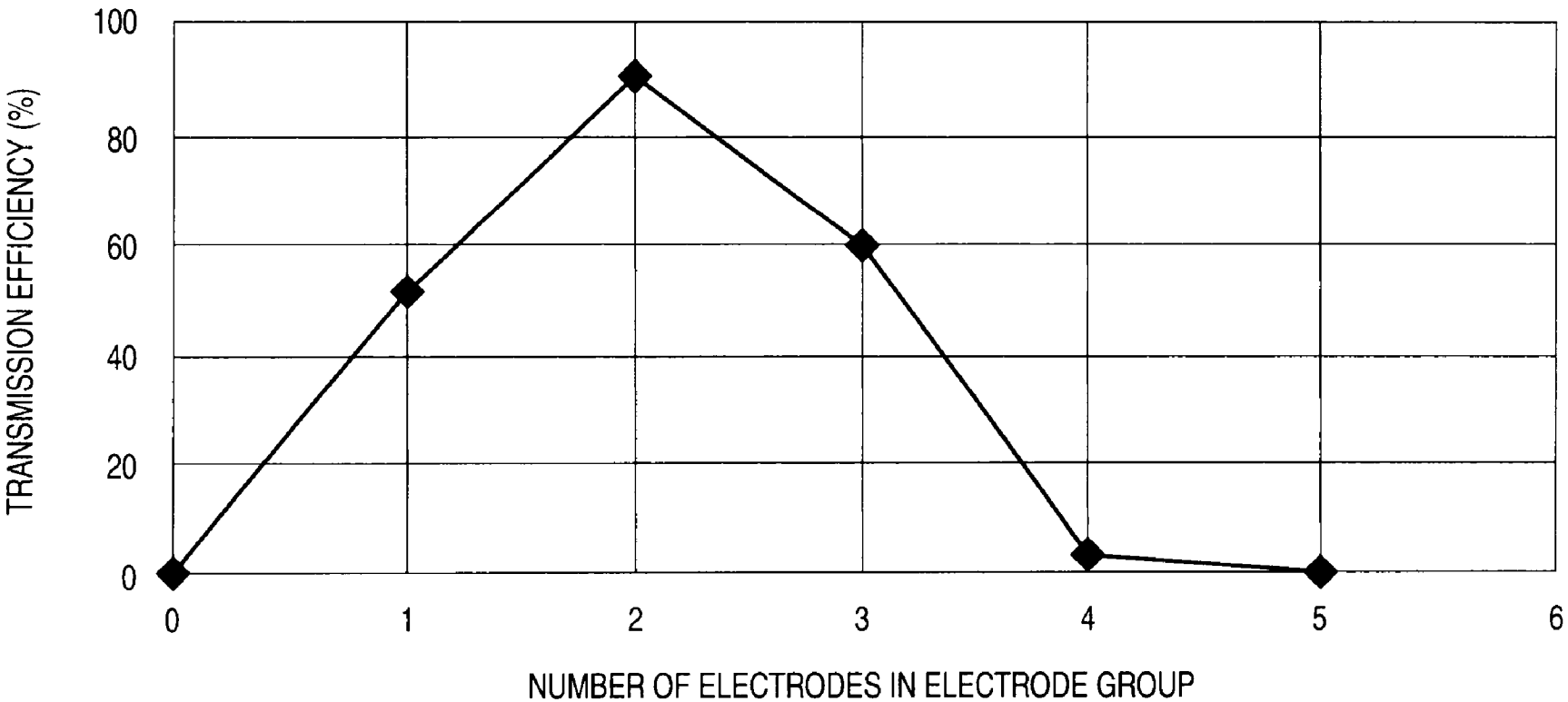
FIG. 3 is a graph showing a relationship between the number of electrode groups and the transmission efficiency of the APF linear ion accelerator, according to the first embodiment of the invention.

The reason that the number of electrodes for each electrode group is designated as "three or smaller" is shown in FIG. 3. FIG. 3 is a graph showing the ratio of an ion beam (ratio of the extracted beam to the injected beam) at which, when the number of electrodes included in each electrode group is changed, acceleration of the beam can still be performed up to the last cell while the beam is existent, i.e., shows the ion beam transmission efficiency (%). It is apparent that when an electrode group consists of five or more electrodes, the transmission efficiency falls substantially to 0, and an ion beam can not be stably accelerated. When the number of electrodes in a group is four, the state is obtained wherein acceleration of an ion beam is barely managed, but the transmission efficiency is about 2%, which is lower than transmission efficiency of 20% for the conventional case obtained using the APF linear ion accelerator. When a transmission efficiency exceeding 20% is employed as a reference, a case in which electrode groups consisting of four or more electrodes are used does not satisfy the reference. On the other hand, the transmission efficiency is 0% for a case in which there are zero electrodes in a group; 50% for a case in which there is one electrode; 90% for a case in which there are two; and about 60% for a case in which there are three. Since for a case in which there are one to three electrodes in a group the transmission efficiency greatly exceeds the conventional 20%, electrodes in a number equal to or greater than one to equal to or smaller than three is included in each electrode group in order to satisfy the reference. According to this rule and using rules (i) and (ii) as prerequisites, the effects shown in FIG. 3 can be provided. Therefore, this point is the feature of the present embodiment. This derives from controlling the positive and negative maximum values of an acceleration phase shown in FIG. 5. A detailed explanation for this will be given later while referring to FIG. 5.

(iv) When each electrode group includes two or more electrodes, the electrode length of the succeeding electrode number is increased so it is greater than the electrode length of the first electrode number.

Figure 5:
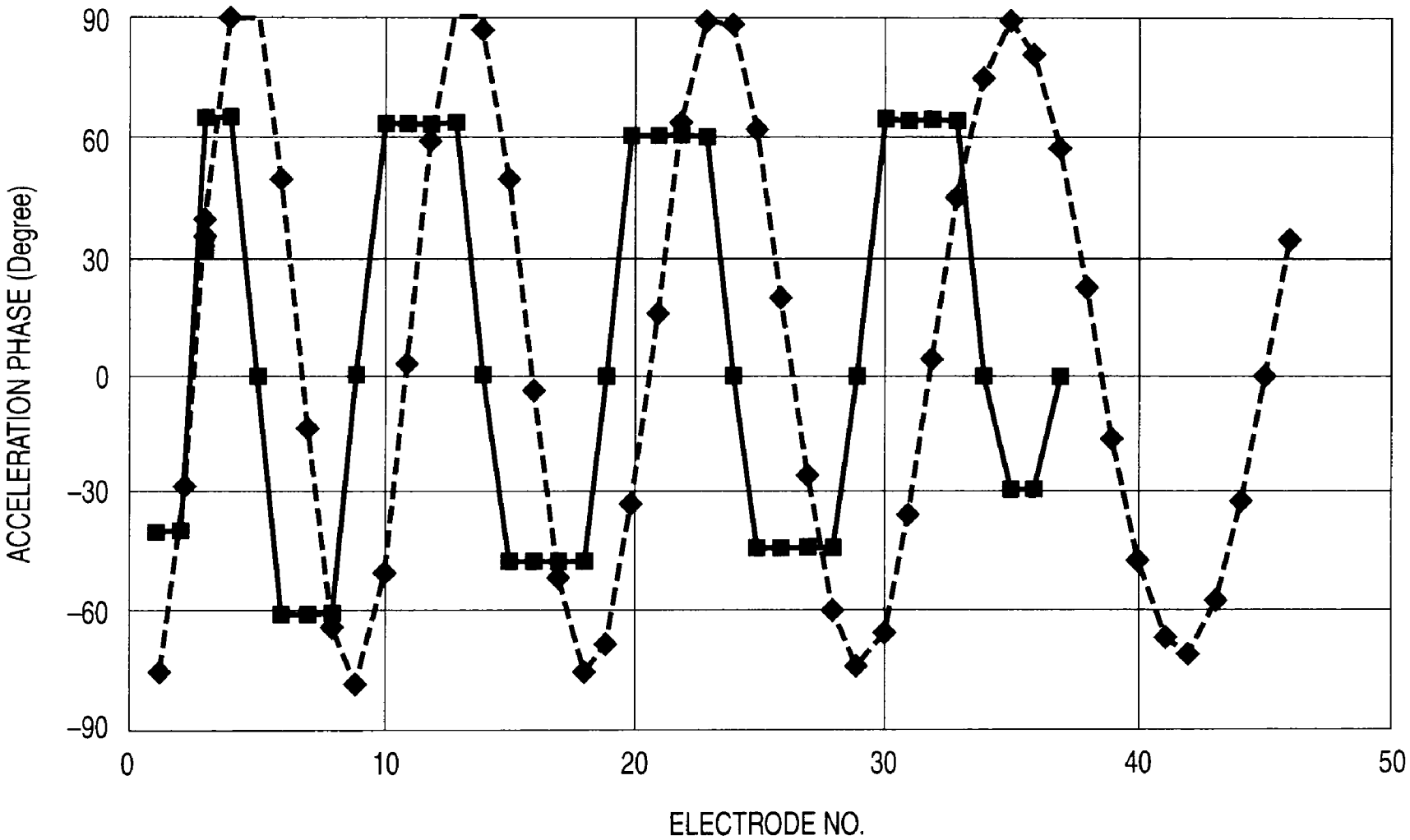
FIG. 5 is a graph showing accelerator phases for the individual gaps of a conventional APF linear ion accelerator and an APF linear ion accelerator of the embodiment of the invention.

This rule is employed because areas in the vicinities of the positive and negative maximum values for the acceleration phase at the electrode position are flattened, as shown in FIG. 5. By employing this arrangement, in addition to rules (i) and (ii), the transmission efficiency can be increased. Since this feature is obtained in addition to the improvement in the transmission efficiency provided by (iii) of the present embodiment, this rule can be selected for use separate from the rule (iii).

(v) The electrode length of the last drift tube 2*b* (corresponding to electrode number 35 in FIG. 2) is included in the half cycle that reduces the electrode length more than the velocity dependent electrode length 4, and is located in a portion where an electrode length and an electrode number are increased together, and a change value relative to the velocity dependent electrode length 4 is almost 0.

In the cyclical change of the electrode length, the location described above corresponds to a location where the beam focusing force in the vertical direction, i.e., in the beam direction of travel, reaches its maximum. Generally, for an accelerator that obtains the focusing force by repeatedly performing the focusing and the diverging of the ion beam, the acceleration phase width reaches its maximum at the position where a focusing element is present that has as a function the focusing of a beam, and reaches its minimum at the position where a diverging element is present that has as a function the diverging of a beam. Since under a predetermined operating condition of the accelerator a product of the acceleration phase width and the momentum spread is stored as a normalized emittance, the momentum spread reaches its minimum at the position where the acceleration phase width is the maximum. That is, the position whereat the focusing force reaches its maximum is the position where the electrode length is increased, and where the absolute value of a change in the electrode length, relative to the velocity dependent electrode length 4, is almost 0. Therefore, at this position, the acceleration phase width is the maximum, and thus, the momentum spread is the minimum. The electrode length of the last drift tube 2*b* is designated in the above described manner because a beam having a small momentum spread is extracted and then injected into the circular accelerator arranged at the succeeding stage, so that the acceleration efficiency of the ion beam to be injected into the circular accelerator can be increased. It should be noted that since these effects are provided separately from the effects obtained according to the rules in (i) to (iv), the use of this rule can be selected independent of the other rules.

(vi) For the drift tube 2 (corresponding to electrode number 1 in FIG. 2) arranged following the first drift tube 2*a*, the electrode length falls in half a cycle during which the electrode length is to be increased more than the velocity dependent electrode length 4, and the value of a change in the electrode length, relative to the velocity dependent electrode length 4, is almost 0.

During the cyclical change of an electrode change, as described above in (v), the above described location is one where the acceleration phase width reaches its maximum. Generally, the acceleration phase width of the beam injected into the accelerator is determined in accordance with a distance relative to the accelerator arranged in the front stage, or to the ion generation source. On the other hand, the accelerator that receives the beam (in this case, the APF linear ion accelerator of this embodiment) stably accelerates only a beam having an acceleration phase width that falls only within a specific range. Therefore, when the injection position is designated as the position at which the acceleration phase width reaches its maximum, the beam current by which the beam acceleration is enabled can be maximum. This is the reason that the above described condition is provided for the drift tube 2 arranged following the first drift tube 2*a*. It should be noted that "the electrode length, for which the value of a change relative to the velocity dependent electrode length 4 is almost 0" specifically indicates that the change value relative to the velocity dependent electrode length 4 is smaller than the change that is consonant with the previously defined phase length. This is because the phase length is determined using the phase width in the direction in which the ion beam is accelerated. This effect is independent of the effects provided according to the rules in (i) to (v). Therefore, this rule can be selected separately from the other rules. All of the rules (iii) to (v) contribute to a considerable increase in the beam current of the final energy that is to be obtained.

Figure 4:
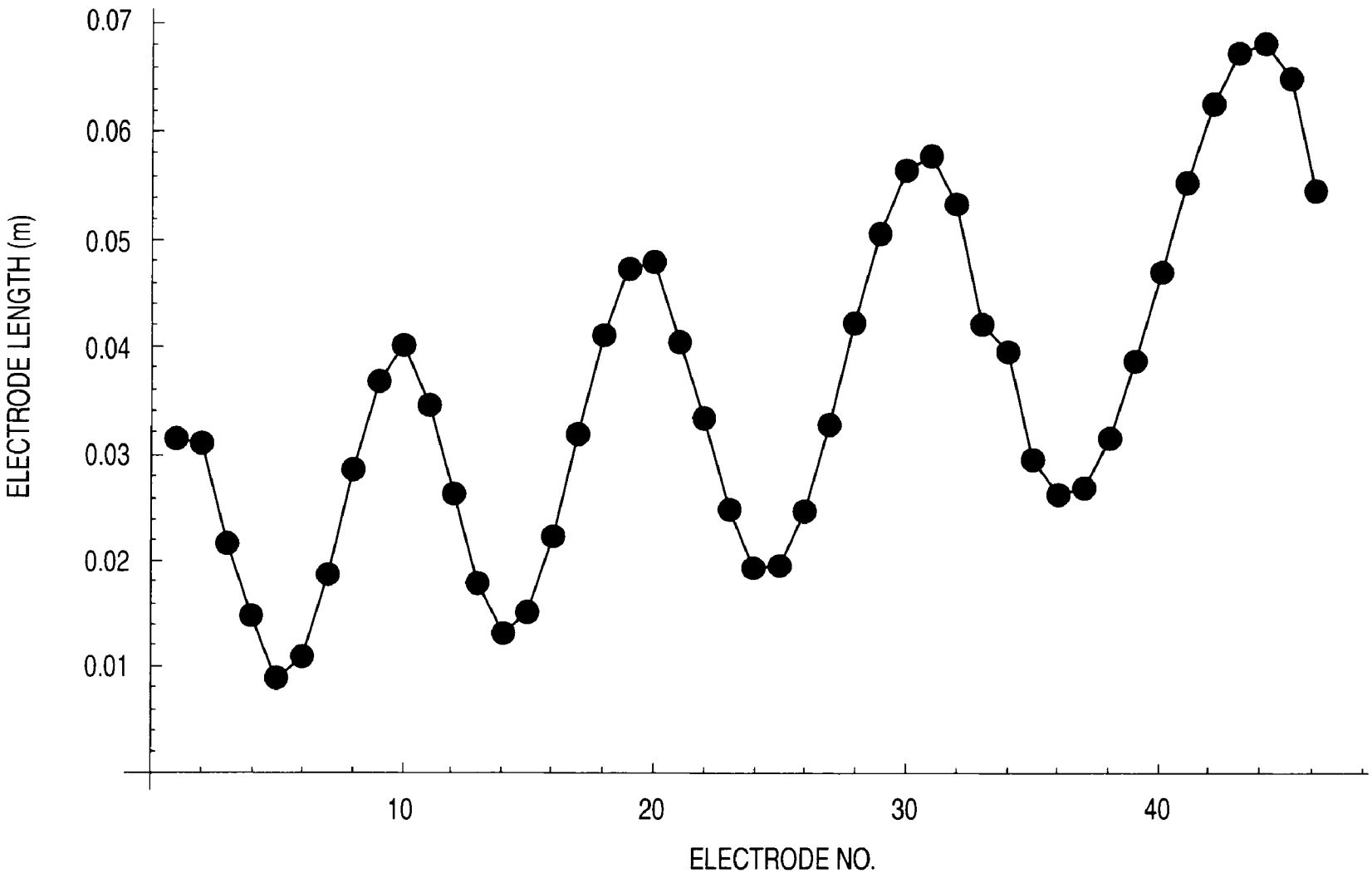
FIG. 4 is a graph showing the individual electrode lengths for a cylindrical electrode array of a conventional APF linear ion accelerator.

While referring to FIG. 5, an explanation will be given for a difference in the effects provided by a conventional APF linear ion accelerator and by the APF linear ion accelerator of this embodiment. FIG. 5 is a graph showing changes in the acceleration phase at the individual acceleration gaps 3 corresponding to the electrode numbers. In FIG. 5, a broken line indicates the changes in an acceleration phase for the conventional APF linear ion accelerator, and a solid line indicates the changes in an acceleration phase for the APF linear ion accelerator of this embodiment. In both cases, a proton beam was employed with an injection energy of 0.7 MeV and an extraction energy of 7.0 MeV; the acceleration frequency of a ratio frequency electric field was 200 MHz, which is a frequency frequently employed for a linear ion accelerator; and the maximum electric field strength was 1.8 times the Kilpatric maximum surface electric field. The electrode lengths of this embodiment were designated according to the rules (i) to (vi); however, for designating the electrode lengths of the conventional APF linear ion accelerator, the rules (i) and (ii) of the embodiment were employed but the rules (iii) to (vi) were not adopted, and the electrode lengths were sequentially and cyclically changed as shown in FIG. 4.

For the conventional APF linear ion accelerator, as well as the electrode length (see FIGS. 4 and 5), the acceleration phase is changed sinusoidally, while the APF ion linear ion accelerator of this embodiment is characterized in that the acceleration phase is changed in a serrated shape. Since the increase in the total length of the APF linear ion accelerator occurs because the absolute maximum value of the acceleration phase is $\pi/2$, in this embodiment, the absolute maximum value is controlled so it is about $\pi/3$, i.e., in the vicinity of 60 degrees along the vertical axis in FIG. 5. Thus, the effective acceleration voltage is raised, compared with that of the conventional APF linear ion accelerator. In order to obtain requested extraction energy, 47 electrodes, i.e., an acceleration cavity of 3.0 m long is required for the conventional accelerator; however, according to the study results obtained for this embodiment, only 36 electrodes, or an acceleration cavity of 2.1 m long is required. Therefore, it can also be said that the forming of a flat topped shape for the change in the acceleration phase, relative to the electrode number, is the point of this embodiment, and when for the change a flat topped shape is formed, the effective acceleration voltage can be greatly increased. Thus, extraction energy at predetermined level can be obtained using a small number of electrodes, i.e., requires a short acceleration cavity. Since the length of the acceleration cavity 1 is equivalent to the length of the accelerator, when the length of the acceleration cavity 1 is shortened, accordingly, the total length of the accelerator can be shortened, and the cost of the accelerator can be reduced. Furthermore, as for other effects, the permitted degree of freedom in the arrangement design is increased, and an accelerator can be provided that is easier to use.

An explanation will now be given for which of the previously described rules (i) to (vi) is in accord with the change of the acceleration phase in the flat topped shape, indicated by a solid line in FIG. 5.

The points provided for the portions other than the portions in the flat topped shape are correlated with the number of electrodes in the increased or reduced electrode group shown in FIG. 2. Therefore, this correlation is in accord with the rule (iii). The number N of points located in portions other than the flat top portions in the flat topped shape are correlated, in the following manner, with the number of electrodes for which the absolute value of the oscillation component of the electrode length exceeds the predetermined value, i.e., are correlated with the number M of electrodes in the electrode group. That is, when N is 0, M is 1. When N is 1 and this point is located at the acceleration phase 0, or when N is 2, M is 2. When N is 3, M is also 3, and when N is 4, M is also 4. While referring to FIGS. 2 and 5, in FIG. 2, M is 1, 2, 2, 2, 2, 2, 2 and 2, and in FIG. 5, N is 0, 1, 1, 1, 1, 1, 1 and 1, and all the acceleration phases for which N is 1 are located at 0. Therefore, it is found that the above described correlation is established. This reflects the following fact. At the acceleration stage using electrodes having small electrode numbers, i.e., at the initial acceleration stage, only a small focusing force may be sufficient because the ion beam energy is still low; however, since the ion beam energy is increased at drift tubes located in the rear portion of the acceleration cavity, a large focusing force is required to focus the ion beam. The above described correlation was obtained by collecting all the analysis results.

Furthermore, the rule (iv), indicating that for each electrode group the electrode length of the succeeding electrode is extended relative to the electrode length of the first electrode, depends on the flat top shaped portions indicated by a solid line in FIG. 5.

In addition, the rule (iv) depends on the presence of drift tubes located in the flat top shaped portions for the change in the acceleration phase that is indicated by the solid line in FIG. 5. That is, since a plurality of drift tubes are allotted to this portion, the electrode length is continuously increased for these electrodes. The meaning of the presence of the flat top shaped portions has been already described, and when a flat top shaped portion is extended, the integral value of the focusing or diverging force is increased, and in either case, the ion beam will collide with the surrounding drift tubes or other structural objects, and will disappear. However, as previously described while referring to FIG. 3, since one to three electrodes are employed to constitute each electrode group, no problem will actually occur.

Further, when this portion is changed from a flat shape to a slightly declined shape, accordingly, the relationship is changed between the electrode lengths of the adjacent electrodes in each increased or reduced electrode group in FIG. 2, i.e., the profile showing the electrode length distribution in FIG. 2 is changed, and the structure of the drift tubes falls outside the optimal value.

Furthermore, as the acceleration process is advanced, the absolute value of the negative minimum value of the acceleration phase becomes smaller than $\pi/3$ (60 degrees), and descends to about $\pi/6$ (30 degrees). This is the result obtained by performing further optimization, and this result also contributes to the increase in the effective acceleration voltage.

The significance of the shortening of the length of an accelerator will now be described. By shortening the length of the accelerator, the installation location can be more flexibly selected, and the construction cost for the installation is also affected. Further, the reduction in the total length also affects the alignment of devices. For example, in the APF linear ion accelerator, the individual drift tubes 2 is aligned with an accuracy of about 0.2 mm, and when the length of the acceleration cavity 1 is extended and the number of drift tubes 2 is increased, alignment is extremely difficult. When the length of an acceleration cavity is about 3 m, the drift tube 2 in the middle is located at a distance of about 1.5 m from either the injection side or the extraction side, so that the middle drift tube 2 can not be reached and touched directly by hand, and alignment is extremely difficult. On the other hand, in this embodiment, since the drift tube 2 in the middle of the acceleration cavity 1 is at a distance of about 1 m from either end, which is sufficiently within arm's reach, alignment is not very difficult. As described above, the alignment process can be easily performed by reducing the length of the accelerator, and the period and the cost required for the installation construction for the apparatus can be reduced. In addition, the alignment accuracy can be easily improved.

Shortening of the length of the accelerator also provides a benefit relative to the power consumption of the apparatus. To explain this benefit, power consumed by the conventional APF linear ion accelerator and power consumed by the APF linear ion accelerator of this embodiment are calculated under the same condition as used for FIG. 5. In this case, assume that the maximum surface electric field is about the same level, and power injected to the acceleration cavity is substantially proportional to the length of the acceleration cavity. When the electric field is actually calculated three-dimensionally under these conditions, about 230 kW is consumed by the conventional APF linear ion accelerator, and about 150 kW is consumed by the APF linear ion accelerator of this embodiment (in either case, power consumed by a beam is excluded). Thus, the power consumption for the acceleration cavity of this embodiment is considerably reduced, when compared with the conventional type. Therefore, the cost of operating the APF linear ion accelerator of this embodiment is also reduced, when compared with the conventional type.

As previously described, in the conventional APF linear ion accelerator, since multiple drift tubes are arranged in a long acceleration cavity and a beam is slowly accelerated by applying comparatively low acceleration energy at the individual acceleration gaps, the period the ion beam is transported in the low energy state is extended. Therefore, the ion beam is greatly affected by the space charge effect, and the ratio of the divergence of the ion beam is increased. Because of the space charge effect, it is especially difficult for proton to be accelerated using a large current until they have reached a high energy, and according to the result obtained by performing beam analysis while considering the space charge effect, a beam current of only about 2 mA could be accelerated under the above described conditions. On the other hand, since the APF linear ion accelerator of this embodiment changes the acceleration phase $\phi 0$ only to about $\pm\pi/3$, the ratio at which the ion energy is increased is greater than the conventional ratio. Therefore, the space charge effect produced during the acceleration process is reduced, and according to the results obtained by performing the beam analysis under the above conditions while considering the space charge effect, the beam current that can be accelerated was about 20 mA. Thus, in the APF linear ion accelerator of this embodiment, the maximum value of the beam current that can be accelerated is increased to about ten times the conventional value. When an APF linear ion accelerator is employed as an injection device for a particle cancer therapy instrument, frequently at least a beam acceleration current of about 5 mA is required. The conventional APF linear ion accelerator can not provide this beam strength, but the APF linear ion accelerator of this embodiment can.

As previously described above, for the conventional APF linear ion accelerator, the acceleration phase $\phi 0$ must be greatly changed to about $\pm\pi/2$ in order to obtain a satisfactory focusing force. On the other hand, when upon application of the acceleration electric field $E=E0\cdot\cos(\phi 0)$ the acceleration phase is shifted a little in one flux of an acceleration ion beam, the radio frequency electric field differs greatly. As a result, the focusing force is greatly changed for the ions located in the center of the ion beam and for the ions located at the edge, and the focusing force for the ions at the edge is reduced. Thus, the ions at the edge diverge, and either fall outside the stable region for acceleration or collide with the electrodes and disappear. Therefore, of a group of ions, only the ions in the vicinity of the center can be accelerated, the transmission efficiency is lowered, and acceleration using a large current is difficult. On the other hand, according to the APF linear ion accelerator of this embodiment, the acceleration phase $\phi 0$ is changed only to about $\pm\pi/3$, at the maximum. Therefore, compared with the conventional case, the focusing force for ions located at the edge does not differ much from that for ions located in the center. Therefore, when the focusing force for the ions in the vicinity of the center of the beam is optimized, many more ions can be accelerated, compared with the conventional type. According to the results obtained by performing beam analysis under the above conditions while considering the space charge effect, it was found that a transmission efficiency of about 20% was obtained for the conventional APF linear ion accelerator, while one of about 90% was obtained for the APF linear ion accelerator of this embodiment. Since the APF linear ion accelerator of this embodiment is superior in transmission efficiency, this accelerator is more appropriate for acceleration using a large current.

The results obtained by comparing the conventional APF linear ion accelerator and the APF linear ion accelerator of this embodiment are shown in the table in FIG. 6. The calculation results are those obtained when proton were accelerated from 0.7 MeV to 7 MeV, and if this parameter is changed, the numerical values in the table will be different. As the mass of ions to be accelerated becomes lighter, and as the energy ratio to be accelerated (extracted energy/injected energy) becomes greater, the above described superior points of the APF linear ion accelerator of this embodiment are enhanced, in comparison to the conventional APF linear ion accelerator.

The APF linear ion accelerator of this embodiment is useful as an injection device for employment, for example, in a particle cancer therapy instrument.

What is claimed is:

1. An APF linear ion accelerator comprising:

an accelerator cavity configured to accelerate a traveling ion beam by a radio frequency electric field;

a radio frequency power supply device configured to generate the radio frequency electric field;

a coaxial tube and a coupler configured to supply the radio frequency electric field generated by the radio frequency power supply device to the acceleration cavity; and a plurality of cylindrical electrodes having hollow central axial portions and linearly arranged in the acceleration cavity in the axial direction with intervening acceleration gaps to have predetermined intervals, wherein the radio frequency electric field supplied to the acceleration cavity via the coaxial tube and the coupler is applied to the acceleration gaps, which gradually accelerates the velocity of an ion beam that passes through the hollow central axial portions of the cylindrical electrodes, thereby extracting the ion beam injected at a predetermined injection energy until a predetermined extraction energy, wherein each of the cylindrical electrode has an electrode length in an arrangement direction of the cylindrical electrodes, the electrode length being a sum of a velocity dependent electrode length and an oscillation component, the velocity dependent electrode length designated in proportional to a traveling velocity in the cylindrical electrode determined as a velocity at which the ion beam is to pass through the cylindrical electrode, the oscillation component obtained by changing an electrode length to positive or to negative with respect to the velocity dependent electrode length pursuant to a predetermined cycle and depending on a position of the plurality of cylindrical electrodes, wherein the cylindrical electrodes in each half of the predetermined cycle include an electrode group containing at least one cylindrical electrode having an electrode length of which the absolute value of the oscillation component is larger than a phase length defined by a length in a direction of accelerating the ion beam which corresponds to half of a predesignated phase width in the direction of accelerating the ion beam, and wherein a number of cylindrical electrodes contained in the electrode group is smaller than a number of cylindrical electrodes allotted to each half of the predetermined cycle, and is equal to or greater than one and equal to or smaller than three.

2. The APF linear ion accelerator according to claim 1, wherein, when the electrode group contains two or more cylindrical electrodes, the electrode length of a cylindrical electrode nearer an ion beam injection end is shorter than the electrode length of a cylindrical electrode that is adjacent toward an ion beam extraction end.

3. The APF linear ion accelerator according to claim 1, wherein a cylindrical electrode located nearest an ion beam extraction end is arranged in a portion where the oscillation component of the electrode length increases from a negative portion as a distance from an ion beam injection end increases, and has an electrode length of which an absolute value of an oscillation component does not exceed the phase length.

4. The APF linear ion accelerator according to claim 1, wherein a cylindrical electrode adjacent to a cylindrical electrode nearest an ion beam injection end is arranged in a portion where the oscillation component of the electrode length increases from a negative portion as a distance from an ion beam injection end increases, and has an electrode length of which an absolute value of the oscillation component does not exceed a phase length.

* * * * *